United States Patent [19]

Becker et al.

[11] Patent Number: 4,993,925

[45] Date of Patent: Feb. 19, 1991

[54] DIAPHRAGM PUMP WITH NOISE INTERCEPTING INSERT

[75] Inventors: Erich Becker; Heinz Riedlinger, both of Bad Krozingen, Fed. Rep. of Germany

[73] Assignee: KNF Neuberger GmbH, Freiburg Munzingen, Fed. Rep. of Germany

[21] Appl. No.: 434,335

[22] Filed: Nov. 13, 1989

[30] Foreign Application Priority Data

Nov. 10, 1988 [DE] Fed. Rep. of Germany ..... 3838141

[51] Int. Cl.[5] ..... F04B 43/02

[52] U.S. Cl. ..... 417/413; 92/99

[58] Field of Search ..... 417/413; 92/85, 99, 92/100

[56] References Cited

U.S. PATENT DOCUMENTS

| | | | |
|---|---|---|---|
| 4,035,107 | 7/1977 | Kesten et al. | 417/413 |
| 4,049,366 | 9/1977 | Becker | 92/99 |
| 4,594,059 | 6/1986 | Becker | 417/439 |

FOREIGN PATENT DOCUMENTS 3005834 3/1989 Fed. Rep. of Germany .

*Primary Examiner*—Leonard E. Smith
*Assistant Examiner*—David L. Cavanaugh
*Attorney, Agent, or Firm*—Peter K. Kontler

[57] ABSTRACT

A diaphragm pump wherein that side of the diaphragm which faces away from the pumping chamber is adjacent a noise intercepting insert. The insert is traversed by the connecting rod of the drive which oscillates the central portion of the diaphragm to draw a fluid into and to expel the drawn fluid from the pumping chamber. A deformable wall of the insert has a marginal portion which is attached to the housing, and this wall is separated from the diaphragm by an elastic distancing cushion of foam rubber or other sound absorbing material. The cushion can constitute a ring or it can consist of a set of projections which are affixed to or integral with the wall and face of the diaphragm. The cushion is compressed between the head of the connecting rod and the wall so that the latter is maintained in stressed condition. The stress upon the wall is selected in such a way that the wall does not perform natural oscillations in response to oscillations which are carried out by the diaphragm as a result of pressure changes in the pumping chamber.

20 Claims, 2 Drawing Sheets

DIAPHRAGM PUMP WITH NOISE INTERCEPTING INSERT

BACKGROUND OF THE INVENTION

The invention relates to improvements in diaphragm pumps, and more particularly to improvements in means for absorbing or intercepting noise which is generated by the diaphragm of a diaphragm pump.

As a rule, the diaphragm of a diaphragm pump is reciprocated by the connecting rod of a drive wherein the connecting rod receives motion from an orbiting eccentric. Reference may be had, for example, to commonly owned German Pat. No. 30 05 834 to Heinz Riedlinger. The marginal portion of the diaphragm is clamped in the housing and the central portion of the diaphragm is connected with the head of the connecting rod. It is also known to employ so-called dual or twin diaphragm pumps with two housings and an electric motor between the housings. Such diaphragm pumps are often used as vacuum pumps or as compressors.

A drawback of conventional diaphragm pumps is that their diaphragms generate pronounced noise. Noise is generated as a result of oscillations which are imparted by the connecting rod as well as due to natural or characteristic vibrations of the diaphragm. The natural or characteristic vibrations develop in response to pressure changes in the pumping chamber of the diaphragm pump.

Heretofore known proposals to reduce the noise emission of diaphragm pumps include total encapsulation of the diaphragm and of the moving means therefor. This applies particularly for that chamber of a diaphragm pump which contains the eccentric and the means for orbiting the eccentric so that the latter enables the connecting rod to oscillate the central portion of the diaphragm. Encapsulation of the diaphragm and of the drive means for the diaphragm brings about a pronounced reduction of noise. However, if the moving means for the diaphragm is fully encapsulated, it cannot be adequately cooled or cannot be cooled to an optimum extent. This, in turn, prevents the diaphragm from raising the pressure of conveyed fluid media above a relatively low maximum permissible value because a further rise of pressure would entail excessive heating of the diaphragm and of the parts which are adjacent to it. The situation is aggravated in the aforementioned dual or twin diaphragm pumps because it is practically impossible to adequately ventilate the electric motor between the two chambers for the eccentrics and other means for oscillating the respective diaphragms.

On the other hand, proper soundproofing of diaphragm pumps is highly desirable, especially when such pumps are put to use in laboratories and similar establishments which are occupied by engineers, scientists, technicians and other persons involved in mental work. A diaphragm pump is likely to raise its noise emission by up to 40 percent whenever the pressure in the pumping chamber changes from superatmospheric to subatmospheric or vice versa. This can seriously affect the occupants of the facility in which the diaphragm pump is put to use, especially if the facility employs numerous pumps and is occupied by a number of persons whose work and comfort are greatly affected by pronounced fluctuations in noise.

OBJECTS OF THE INVENTION

An object of the invention is to provide a diaphragm pump with novel and improved means for reducing the emission of noise.

Another object of the invention is to provide a diaphragm pump which can be cooled in an optimum way even though its noise emission is not more pronounced or is considerably less than that of a standard diaphragm pump which cannot be adequately cooled because it is not supposed to generate excessive noise.

A further object of the invention is to provide a diaphragm pump wherein the generation of noise is reduced in a simple, efficient and inexpensive manner.

An additional object of the invention is to provide a novel and improved sound intercepting and/or absorbing barrier between the diaphragm and certain other parts of a diaphragm pump.

Still another object of the invention is to provide a diaphragm pump wherein pronounced fluctuations of pressure in the pumping chamber do not result in pronounced fluctuations or any fluctuations of noise.

A further object of the invention is to provide a novel and improved twin or dual diaphragm pump.

Another object of the invention is to provide a diaphragm pump wherein the noise intercepting or damping part or parts occupy space which is readily available in the pump housing.

An additional object of the invention is to provide a diaphragm pump which is quieter than heretofore known pumps even though it permits optimal cooling of the interior of the pump housing to thus prolong the useful life of the diaphragm and of bearings for the moving parts of the pump.

Another object of the invention is to provide a diaphragm pump wherein the diaphragm can raise the pressure of conveyed fluid to a maximum achievable value without entailing overheating of the diaphragm and/or other sensitive parts.

SUMMARY OF THE INVENTION

The improved diaphragm pump comprises a housing, at least one diaphragm which is installed in and defines with the housing a pumping chamber at one side of the diaphragm, and noise intercepting means provided in the housing at the other side of the diaphragm. The housing and the noise intercepting means (hereinafter called insert for short) define a second chamber which is separated from the pumping chamber by the insert as well as by the diaphragm, and the pump further comprises means for moving the diaphragm with reference to the housing. Such moving means includes motion transmitting means (e.g., a connecting rod receiving motion from an eccentric in the second chamber) provided in the second chamber, extending through the insert and engaging the diaphragm.

The insert preferably comprises a deformable wall having a marginal portion affixed to the housing and a central portion traversed by the connecting rod The wall is or can be substantially flat, and the noise which is produced by the wall as a result of oscillations arising in response to movement of the connecting rod is less pronounced than the noise which is attributable to oscillations of the diaphragm in response to movement of the connecting rod and/or as a result of pressure changes in the pumping chamber when the pump is in use.

The insert preferably further comprises elastic distancing means (e.g., a cushion) between the deformable wall and the diaphragm. The connecting rod preferably comprises a head which is disposed between the diaphragm and the distancing means. The distancing means can include or constitute a ring which consists of or contains a material (such as foam rubber) having pronounced sound absorbing characteristics. The distancing means need not constitute a discrete part of the insert; for example, such distancing means can be an integral part of the wall and can include a plurality of projections provided on the wall at the other side of the diaphragm. The wall can constitute a substantially circular disc. The connecting rod can be secured to the central portion of the wall to maintain the wall under tension exceeding that which is caused by vibratory stresses applied to the wall as a result of oscillation of the diaphragm under the action of the connecting rod. The distancing means is or can be compressed between the head of the connecting rod and the wall to thereby maintain the wall in stressed condition.

If the distancing means includes or constitutes an elastic ring, the peripheral surface of such ring is located in the region of the marginal portion of the deformable wall. Such peripheral surface may but need not abut the internal surface of the housing, and the ring may but need not be actually affixed to the housing and/or to the marginal portion of the deformable wall. The head of the connecting rod can have a substantially circular outline and its diameter is or can be at least slightly less than the diameter of the ring-shaped distancing means.

That (second) portion of the deformable wall which is surrounded by the marginal portion can be loose in the housing, at least prior to insertion of the distancing means, and can resemble a dish or cup. In other words, the dimensions of the second portion of the deformable wall can be selected with a view to ensure that such second portion is slack because it contains an excess of material in the radial direction of the housing.

The novel features which are considered as characteristic of the invention ar set forth in particular in the appended claims The improved diaphragm pump itself, however, both as to its construction and the mode of assembling and operating the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
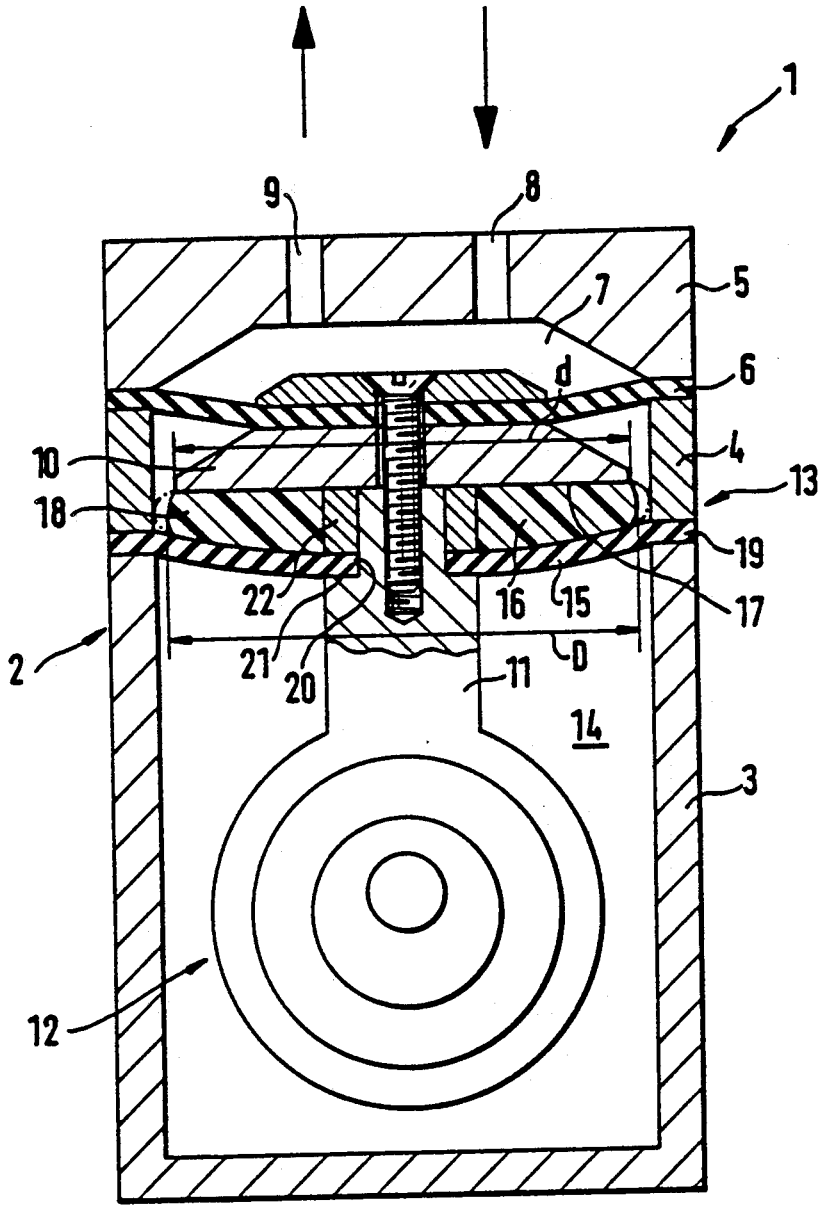
FIG. 1 is a central sectional view of a diaphragm pump with a noise intercepting insert which embodies one form of the invention.

FIG. 1 shows a first diaphragm pump 1 which embodies a novel noise intercepting or damping insert 13. The pump 1 further comprises a composite housing 2 which sealingly engages the marginal portion of a flexible diaphragm 6 (which may but need not be elastic) and defines with the latter a pumping chamber 7 adjacent the upper side of the diaphragm as seen in FIG. 1. The insert 13 is adjacent the other (lower) side of the diaphragm 6 and defines with the housing 2 a second chamber 14 for a drive 12 serving as a means for moving the central portion of the diaphragm relative to the housing. The moving means 12 comprises an eccentric in the chamber 14 and a motion transmitting connecting rod 11 which is oscillated by the eccentric and extends through the insert 13. A substantially circular head 10 of the connecting rod 11 is located between the diaphragm 6 and a deformable elastic distancing cushion 18 of the insert 13. The connecting rod 11 further includes a disc in the pumping chamber 7 and a threaded fastener which connects the disc to the head 10 and extends through the central portion of the diaphragm 6. A somewhat similar diaphragm pump (but without the noise intercepting insert 13) is shown and described in commonly owned U.S. Pat. No. 4,594,059 granted June 10, 1986 to Erich Becker for "Diaphragm Pump".

The housing 2 comprises a tubular main portion or section 3 which surrounds the second chamber 14, an annular portion or section 4 between the marginal portion of the diaphragm 6 and the marginal portion of a deformable wall 15 (e.g., a rubber wall) forming part of the insert 13, and an end wall 5 overlying the diaphragm 6 and provided with openings 8, 9 for admission of a fluid into and for evacuation of fluid from the pumping chamber 7. The prime mover which forms part of the moving means 12 and serves to rotate the shaft for the eccentric in the second chamber 14 is not shown in FIG. 1. The marginal portion of the diaphragm 6 is sealingly clamped between the end wall 5 and the annular section 4, and the marginal portion 19 of the deformable wall 15 of the insert 13 is sealingly clamped between the sections 3,4 of the housing 2.

The purpose of the insert 13 is to intercept noise which is generated as a result of oscillation of the diaphragm 6 by the connecting rod 11 of the moving means and/or as a result of vibrations induced by pressure changes in the pumping chamber 7. In other words, the insert 13 prevents the transmission of noise, or at least reduces the transmission of noise, from the diaphragm 6 toward that end wall of the housing 2 which is remote from the diaphragm and bounds the lowermost portion of the second chamber 14 (as seen in FIG. 1). An important advantage of the insert 13 is that the parts in the chamber 14 can be cooled in a most efficient way without risking the propagation of pronounced noise from the interior of the housing 2 by way of those parts of the cooling means which extend between the chamber 14 and the area around the housing. Efficient cooling of the parts in the chamber 14 is desirable and advantageous because this prolongs the useful life of the bearings for moving parts, of the diaphragm 6 and hence of the entire diaphragm pump.

As mentioned above, the noise intercepting or damping insert 13 in the housing 2 of the pump 1 of FIG. 1 comprises a substantially disc-shaped deformable wall 15 and an elastic distancing cushion 18. The latter includes or constitutes a ring 16 of foam rubber or other elastic material having satisfactory sound absorbing characteristics. The ring 16 is interposed between the adjacent surface 17 of the head 10 of the connecting rod 11 and the wall 15 and is maintained in compressed condition so that it stresses the central portion of the wall 15 within the confines of the marginal portion 19. The wall 15 resembles a diaphragm and may but need not necessarily be elastic. The stress upon the wall 15

(as a result of compression of the cushion 18 between the head 10 and the wall 15) is preferably selected in such a way that it exceeds the stresses to which the wall 15 is subjected by forces transmitted from the diaphragm 6 in response to pressure changes in the pumping chamber 7. Thus, though the central portion of the wall 15 is oscillated by the connecting rod 11 at a frequency which is determined by the RPM of the shaft for the eccentric in the second chamber 14, the wall 15 does not perform any (or any appreciable) natural or characteristic vibrations. Therefore, the wall 15 does not constitute a means for transmitting noise to the second chamber 14, i.e., the wall 15 and the cushion 18 of the insert 13 intercept all, or at least the major part of, noise which is generated by the diaphragm 6.

Foam rubber has been found to constitute a highly satisfactory material for the cushion 18 because such material exhibits pronounced sound damping characteristics and can undergo pronounced compression to thereby stress the deformable wall 15 to a desired extent.

The central portion of the wall 15 is provided with an opening 20 through which the connecting rod 11 extends. That portion of the wall 15 which surrounds the opening 20 overlies an annular shoulder 21 of the connecting rod. The shoulder 21 cooperates with a sleeve-like portion 22 of the connecting rod 11 to clamp the wall 15 in the region around the opening 20. One end face of the sleeve-like portion 22 overlies the wall 15 and its other end face abuts the adjacent surface 17 of the head 10.

FIG. 1 further shows that the diameter D of the ring 18 can exceed, at least slightly, the diameter d of the head 10. In fact, and as indicated in FIG. 1 by phantom lines, the peripheral surface of the ring 18 can extend all the way to and can abut the internal surface of annular section 4 of the housing 2. The marginal portion of such enlarged ring 18 can be affixed to the housing section 4 and/or to the adjacent portion of the wall 15, i.e., the ring 18 can be affixed to the housing and/or to the wall 15 in the region of marginal portion 19 of the wall. A relatively large ring 18 (e.g., a ring the peripheral surface of which extends all the way to the clamped marginal portion 19 of the wall 15) contributes to the noise intercepting or damping action of the insert 13 because it overlies at least the major part of the adjacent side of the wall 15.

Figure 2:
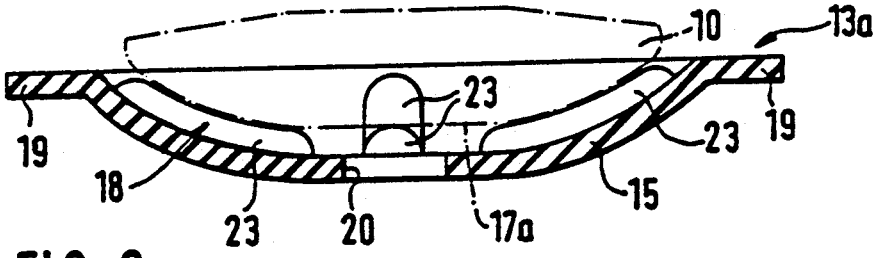
FIG. 2 is a central sectional view of a modified noise intercepting insert, with a portion of the means for moving the diaphragm indicated by phantom lines.
Figure 3:
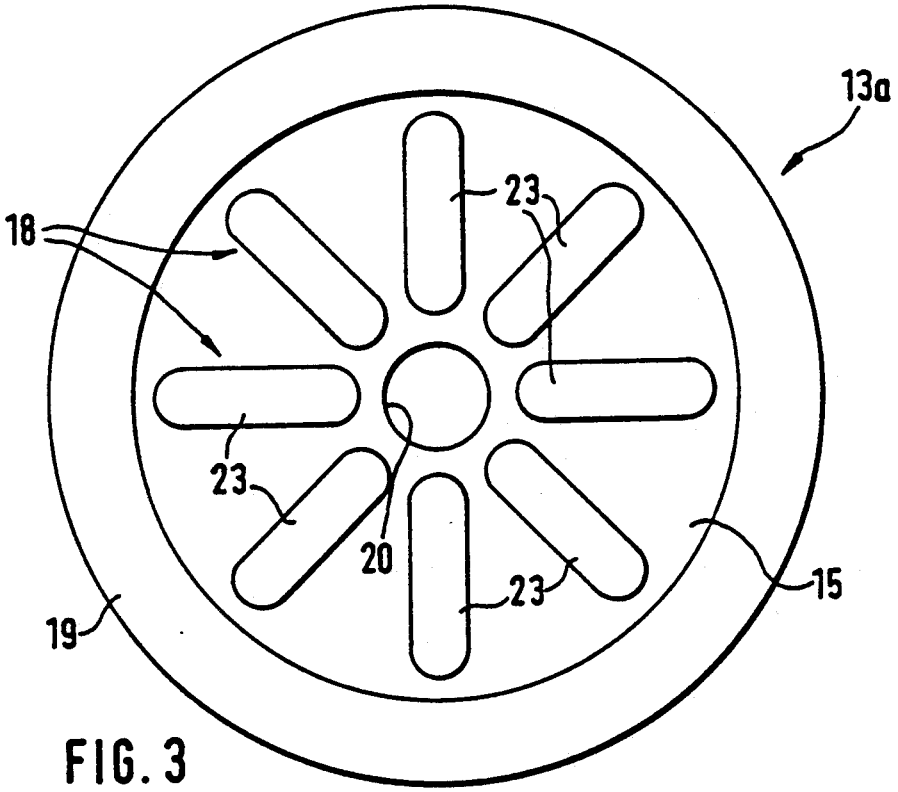
FIG. 3 is a plan view of the insert which is shown in FIG. 2.

FIGS. 2 and 3 show a one-piece noise intercepting insert **13*a* which comprises a substantially cupped or dished deformable wall 15 and a distancing cushion 18 integral with or connected to the wall 15 and disposed at that side of this wall which confronts the diaphragm 6 (not shown in FIGS. 2 and 3) when the marginal portion 19 of the wall is properly clamped in the housing in a manner as shown for the wall 15 of the insert 13 of FIG. 1. The cushion 18 includes a plurality of substantially radially extending elongated projections 23 which are engaged by the adjacent surface 17*a* of the head 10 (indicated in FIG. 2 by phantom lines) of the connecting rod and are compressed in order to properly stress the wall 15. When the head 10 is moved away from the projections 23, the wall 15 is preferably slack in the housing, i.e., it has a surplus of material in the radial direction of the insert 13*a* and is properly stressed in response to compression of projections 23 between the central portion of this wall and the head 10. The projections 23 resemble ribs and are integral with or affixed to the adjacent side of the wall 15. The configuration of the surface 17*a* of the head 10 is selected with a view to ensure predictable compression of the elastically deformable projections 23 which together form the distancing cushion 18 of the insert 13*a*. This, in turn, ensures that the wall 15 does not transmit any, or any appreciable, noise into the adjacent second chamber of the housing, i.e., the wall 15 is not influenced by the diaphragm in a sense to perform natural or characteristic oscillations which would result in transmission of noise into the chamber for the eccentric forming part of the means for moving the diaphragm relative to the housing. In other words, though the central portion of the wall 15 of FIGS. 2 and 3 is compelled to move back and forth in response to movements of the connecting rod including the head 10, the wall 15** does not or need not perform any noise-generating natural or characteristic oscillations.

The noise intercepting insert **13*a* of FIGS. 2 and 3 can further comprise a second cushion (e.g., a cushion corresponding to the ring 16 of FIG. 1) which is then installed between the projections 23 and the head 10 of the connecting rod. This enhances the noise intercepting action of the insert 13*a* because the noise intercepting effect of the wall 15 and of the projections 23** is enhanced by the noise intercepting effect of the second cushion.

Irrespective of whether the cushion comprises a ring (as shown at 18 in FIG. 1), a set of projections (as shown at 23 in FIGS. 2 and 3) or a ring and a set of projections, the distance between the head 10 of the connecting rod 11 and the central portion of the wall 15 is less than the corresponding dimension of the insert. Thus, the insert is preferably compressed between the head 10 and the central portion of the wall 15 to ensure that the wall is adequately stressed in fully assembled condition of the pump. Adequate stressing of the wall 15 can be further enhanced by properly selecting the dimensions of this wall, i.e., the slack of the central portion of the wall 15 within the marginal portion 19 in the absence of elastic cushion or cushions. FIG. 1 shows that the wall 15 is substantially flat. The wall 15 of FIGS. 2 and 3 more closely resembles a cup-shaped body.

The wall 15 is or can be initially flat to resemble a plain disc the marginal portion 19 of which is ready to be clamped between the housing sections 3 and 4. The central portion of such initially flat disc-shaped wall 15 is thereupon stressed and (if the wall 15 is elastic) caused to bulge toward and into the second chamber 14 as a result of stressing by the compressed distancing cushion or cushions 18 and/or 23. Alternatively, the wall 15 can be formed as a cupped or dished body which comprises an excess of material in the radial direction (as compared with an initially flat disc-shaped wall), and the depth of the cupped or dished central portion of such wall can be increased as a result of stressing by the cushion or cushions provided, of course, that the wall 15 is elastic. An at least slightly cupped or dished wall 15 is preferred in many instances because the conditions are more predictable when the pump is in use and that portion of the connecting rod 11 which extends through the wall 15 performs a composite movement having an axial component as well as radial components. Thus, a plain disc-shaped wall 15 offers a much greater resistance to radial movements of the adjacent portion of the connecting rod 11 (which is driven by the eccentric of the moving means 12 in the second chamber 14) than a wall the central portion of which is a cup-shaped body. In other words, the central portion of a cupped wall 15 can undergo deformation in response to combined radial and axial movements of the adjacent portion of the connecting rod 11 without additional (or without pronounced additional) stressing of this material. The situation is different (i.e., the additional stressing is more pronounced and less predictable) if the wall 15 resembles a flat disc, at least prior to stressing by the compressed insert or inserts. The energy requirements of the prime mover for the eccentric which moves the connecting rod 11 can be reduced if the wall 15 does not offer a pronounced resistance to radial movements of the adjacent portion of the connecting rod. Any and all desirable or necessary stressing of the wall 15 can be achieved by appropriate selection of the dimensions and/or material of the cushion including the ring 18 and/or the projections 23. This applies for walls 15 which are originally flat discs as well as for walls which are cupped or dished prior to stressing by the cushion. The excess of material in the cupped or dished central portion of an originally cup-shaped or dished wall 15 brings about the aforediscussed advantages, i.e., less pronounced resistance of the wall to radial movements of the adjacent portion of the connecting rod 11 and a reduction of energy requirements of the prime mover of the moving means 12.

The projections 23 can be formed simultaneously with the wall 15 of the insert 13*a*. However, it is equally within the purview of the invention to produce the projections 23 in a separate step and to thereupon connect (e.g., by means of an adhesive) the prefabricated projections to a prefabricated wall 15. Such mode of making the insert 13*a* is resorted to if the manufacturer of the pump desires to employ a wall 15 the material of which has an elasticity and/or other characteristics departing from that or those of the material of the projections 23. Moreover, this might simplify the making and reduce the cost of the insert 13*a*. For example, the manufacturer may wish to make the wall 15 of a material which exhibits first noise suppressing or absorbing characteristics and to select the material of the projections 23 with a view to ensure that the cushion including a set of such projections will exhibit different second noise suppressing or absorbing characteristics. Furthermore, the manufacturer might wish to make the wall 15 of a material the elasticity of which departs from that of the material of the projections 23.

An advantage of a one-piece insert (13*a*) over a composite insert is that a one-piece insert can be installed more rapidly and in a simpler and less expensive way.

Experiments with diaphragm pumps indicate that a transition from subatmospheric pressure to superatmospheric pressure in the pumping chamber 7 or vice versa entails a pronounced stressing of the diaphragm 6 and a rise of noise emission of up to 40 percent (as compared with noise emission during normal operation of the pump). Experiments further indicate that, if the pump is equipped with the improved noise intercepting insert 13 or 13*a*, the aforediscussed rise of noise emission is eliminated, either completely or nearly completely.

Still further, experiments with the improved diaphragm pump indicate that propagation of noise from the second chamber 14 of the pump housing 2 (when the parts in the chamber 14 are cooled in the most efficient way) is much less pronounced than in conventional diaphragm pumps wherein the second chamber is properly ventilated but which do not employ the improved insert 13 or 13*a*. In fact, the generation of noise by the improved pump, wherein the parts in the second chamber 14 are cooled in an optimum way) is much less pronounced than in conventional pumps wherein the second chamber is completely sealed (i.e., wherein the cooling is unsatisfactory) for the express purpose of reducing the emission of noise.

It has been ascertained that, if the wall 15 is properly stressed by one or more elastic cushions, the transmission of noise into the second chamber 14 of the pump housing 2 does not increase at all, or increases only negligibly, when the pressure in the pumping chamber 7 rises from 0.5 bar below atmospheric pressure (suction stroke of the diaphragm 6) to 3 bar above atmospheric pressure (expulsion stroke of the diaphragm). As mentioned above, such fluctuations of pressure in the pumping chamber of a conventional diaphragm pump can entail a 40-percent increase of transmission of noise to the second chamber of the pump housing.

Figure 4:
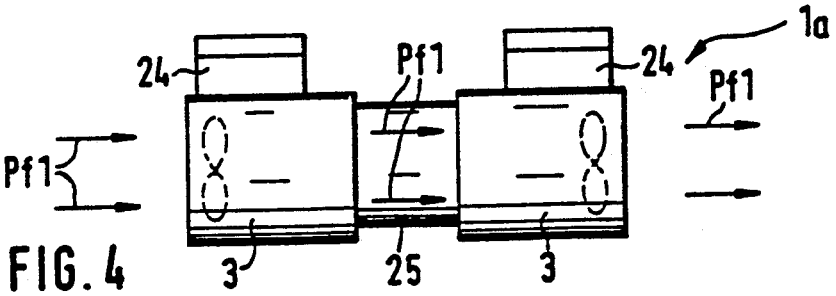
FIG. 4 is a schematic elevational view of a twin or dual diaphragm pump which embodies the invention.

FIG. 4 shows certain components of a dual or twin diaphragm pump la wherein the means for moving two diaphragms comprises two heads 24. These heads receive motion from a prime mover 25 (e.g., an electric motor) between the tubular sections 3 of the twin housing. A drawback of conventional twin diaphragm pumps is that it is not possible to properly ventilate the prime mover because this would have resulted in the emission of excessive noise. In other words, cooling of prime movers in conventional twin diaphragm pumps is nil or negligible. However, if the twin diaphragm pump is equipped with noise intercepting inserts of the type shown in FIG. 1 or in FIGS. 2 and 3, the transmission of noise to the housing sections 3 is negligible or nonexistent so that the prime mover 25 can be cooled in an optimum way without risking the emission of pronounced noise. The arrows Pfl indicate that the prime mover 25 of FIG. 4 can be cooled by a coolant (such as air) which is conveyed along one or more straight or nearly straight paths and can also be conveyed through the housing sections 3. Thus, adequate cooling without the emission of excessive noise is possible in single diaphragm pumps as well as in series-connected diaphragm pumps by the novel expedient of installing a noise intercepting insert at that side of each diaphragm which faces away from the pumping chamber 7 and confronts the second pumping chamber (14) in the housing. As mentioned above, adequate cooling of the second chamber prolongs the useful life of the bearings for moving parts and of the diaphragm or diaphragms.

The entire noise intercepting insert can consist of a wall 15 or an equivalent of such wall, i.e., the elastically deformable distancing cushion or cushions are optional. However, such cushion or cushions are desirable and advantageous because they enhance the noise suppressing action of the insert and perform the additional function of adequately stressing the central portion of the wall 15.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A diaphragm pump comprising a housing; at least one diaphragm installed in and defining with said housing a pumping chamber at one side of the diaphragm; and noise intercepting means provided in said housing at the other side of said diaphragm, said noise intercepting means including a deformable wall disposed in and connected to said housing, and elastic distancing means between said wall and said diaphragm.

2. The pump of claim 1, wherein said housing and said noise means define a second chamber and further means for moving said diaphragm wit to said housing, said moving means including transmitting means provided in said second extending through said noise intercepting engaging said diaphragm.

3. The pump of claim 1, wherein said deformable wall has a marginal portion affixed to said housing and a central portion, and further comprising means for moving said diaphragm with reference to said housing including motion transmitting means connected to and extending through said deformable wall and engaging said diaphragm.

4. The pump of claim 3, wherein said deformable wall is substantially flat and the noise which is produced by said wall as a result of oscillations arising in response to movement of said deformable motion transmitting means is less pronounced than the noise which is attributable to oscillations of said diaphragm in response to movement of said motion transmitting means and pressure changes in said pumping chamber.

5. The pump of claim 1, further comprising means for moving said diaphragm with reference to said housing, said moving means including motion transmitting means extending through said wall and through said distancing means and having a head between said diaphragm and said distancing means.

6. The pump of claim 1, wherein said distancing means includes a ring consisting of a material having sound absorbing characteristics.

7. The pump of claim 6, wherein said ring contains foam rubber.

8. The pump of claim 1, wherein said distancing means is provided on said wall.

9. The pump of claim 8, wherein said distancing means includes projections provided on said wall at said other side of said diaphragm.

10. The pump of claim 9, wherein said wall includes a substantially circular disc.

11. The pump of claim 9, wherein said projections are integral with said wall.

12. A diaphragm pump comprising a housing; at least one diaphragm installed in and defining with said housing a pumping chamber at one side of the diaphragm; noise intercepting means provided in said housing at the other side of said diaphragm, said noise intercepting means including a deformable wall having a marginal portion affixed to said housing and a central portion; and means for moving said diaphragm with reference to said housing including motion transmitting means extending through and connected with the central portion of said deformable wall to maintain said deformable wall under tension exceeding that which is caused by vibratory stresses applied to said deformable wall as a result of oscillation of the diaphragm under the action of said motion transmitting means.

13. A diaphragm pump comprising a housing; at least one diaphragm installed in and defining with said housing a pumping chamber at one side of the diaphragm; noise intercepting means provided in said housing at the other side of said diaphragm; and means for moving said diaphragm with reference to said housing including motion transmitting means extending through said noise intercepting means and including a head between said diaphragm and said noise intercepting means, said noise intercepting means including a deformable wall having a marginal portion affixed to said housing and a central portion connected with said motion transmitting means, said noise intercepting means further including elastic distancing means compressed between said head and said deformable wall to maintain said deformable wall in stressed condition.

14. A diaphragm pump comprising a housing; at least one diaphragm installed in and defining with said housing a pumping chamber at one side of the diaphragm; and noise intercepting means provided in said housing at the other side of said diaphragm, said noise intercepting means including a deformable wall having a marginal portion affixed to said housing and elastic distancing means interposed between said deformable wall and said diaphragm and having a peripheral surface in the region of the marginal portion of said deformable wall.

15. The pump of claim 14, wherein said peripheral surface abuts said housing.

16. The pump of claim 14, wherein said distancing means is affixed to said housing in the region of said peripheral surface.

17. The pump of claim 14, further comprising means for moving said diaphragm with reference to said housing including motion transmitting means extending through said noise intercepting means and having a substantially circular head between said distancing means and said diaphragm, said distancing means including a ring having a first diameter and said head having a second diameter smaller than said first diameter.

18. A diaphragm pump comprising a housing; at least one diaphragm installed in and defining with said housing a pumping chamber at one side of the diaphragm; and noise intercepting means provided in said housing at the other side of said diaphragm, said noise intercepting means including a deformable wall having a marginal portion affixed to said housing and a loose second portion surrounded by said marginal portion.

19. The pump of claim 18, wherein said loose second portion is cupped.

20. A diaphragm pump comprising a housing; at least one diaphragm installed in and defining with said housing a pumping chamber; means for moving said diaphragm with reference to said housing including motion transmitting means engaging said diaphragm; and noise intercepting means provided in said housing at the other side of said diaphragm, said noise intercepting means including a deformable wall disposed in and connected to said housing, and elastic distancing means between said deformable wall and said motion transmitting means.

* * * * *